US006820704B2

(12) United States Patent
Mourik et al.

(10) Patent No.: US 6,820,704 B2
(45) Date of Patent: Nov. 23, 2004

(54) ROCK BIT SEAL WITH EXTRUSION PREVENTION MEMBER

(75) Inventors: Nephi Mourik, Provo, UT (US); Chris Cawthorne, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 29 days.

(21) Appl. No.: 10/212,417

(22) Filed: Aug. 5, 2002

(65) Prior Publication Data

US 2003/0029645 A1 Feb. 13, 2003

Related U.S. Application Data

(60) Provisional application No. 60/310,929, filed on Aug. 8, 2001.

(51) Int. Cl.[7] ..... E21B 10/22
(52) U.S. Cl. ..... 175/371; 175/359
(58) Field of Search ..... 175/371, 372, 175/359, 367

(56) References Cited

U.S. PATENT DOCUMENTS 3,449,024 A 6/1969 Lichte
4,179,003 A * 12/1979 Cooper et al. ..... 175/371
4,200,343 A * 4/1980 Highsmith ..... 384/94
4,666,001 A 5/1987 Burr
5,009,519 A * 4/1991 Tatum ..... 384/94
5,360,076 A 11/1994 Kelly, Jr. et al.
5,362,073 A 11/1994 Upton et al.
5,791,421 A 8/1998 Lin
5,842,700 A 12/1998 Fang et al.
5,842,701 A 12/1998 Cawthorne et al.
5,944,125 A 8/1999 Byrd
6,026,917 A 2/2000 Zahradnik et al.
6,536,542 B1 3/2003 Fang et al.

* cited by examiner

*Primary Examiner*—Zakiya Walker
(74) *Attorney, Agent, or Firm*—Jeffer, Mangels, Butler & Marmaro LLP

(57) ABSTRACT

Annular seals of this invention comprise an elastomeric seal body that is configured to fit within a seal gland of a rock bit. The seal comprises a first seal surface, for providing a seal along a dynamic rotary surface formed between the seal body and one portion of the rock bit, and a second seal surface, for providing a seal between the seal body and another portion of the rock bit. The annular seal further comprises an extrusion prevention member that is positioned adjacent a surface of the seal body between the first and second seal surfaces. The extrusion prevention member can be integral, partially-attached, or independent of the seal body. The extrusion prevention member is preferably formed from a material having a hardness that is greater than that of the seal body. The member is positioned along the seal body at a location adjacent a groove, formed between opposed members of the rock bit, to act as a physical barrier to prevent the seal from being extruded therethrough.

27 Claims, 6 Drawing Sheets

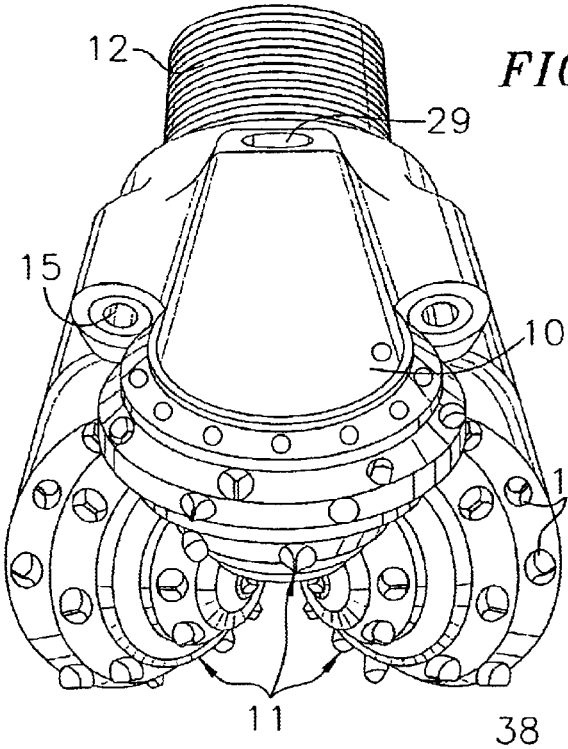
FIG. 1
FIG. 2
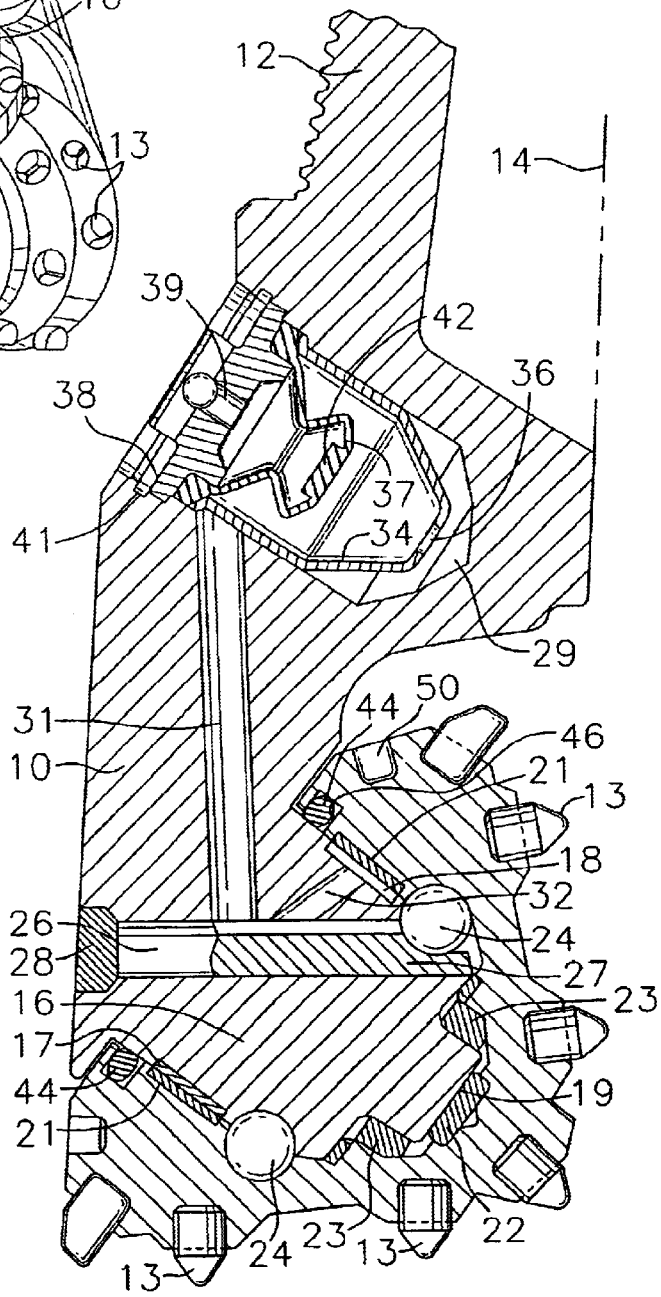

ROCK BIT SEAL WITH EXTRUSION PREVENTION MEMBER

RELATION TO COPENDING PATENT APPLICATION

This patent application claims priority from U.S. Provisional Patent Application Ser. No. 60/3 10,929 that was filed on Aug. 8, 2001, and which is corporated herein by reference.

FIELD OF THE INVENTION

This invention relates to annular seals used for providing a seal between opposed journal and cone surfaces in a rock bit or drill bit for drilling oil wells or the like and, more particularly, to a seal that is specially constructed to resist being extruded from a seal cavity in such rock bit.

BACKGROUND OF THE INVENTION

Heavy-duty drill bits or rock bits are employed for drilling wells in subterranean formations for oil, gas, geothermal steam, minerals and the like. Such drill bits have a body connected to a drill string and a plurality, typically three, of hollow cutter cones mounted on the body for drilling rock formations. The cutter cones are mounted on steel journals or pins integral with the bit body at its lower end. In use, the drill string and bit body are rotated in the bore hole, and each cone is caused to rotate on its respective journal as the cone contacts the bottom of the bore hole being drilled. As such a rock bit is used for drilling in hard, tough formations, high pressures and temperatures are encountered.

When a drill bit wears out or fails as a bore hole is being drilled, it is necessary to withdraw the drill string for replacing the bit. The amount of time required to make a round trip for replacing a bit is essentially lost from drilling operations. This time can become a significant portion of the total time for completing a well, particularly as the well depths become great. It is therefore quite desirable to maximize the service life of a drill bit in a rock formation. Prolonging the time of drilling minimizes the time lost in "round tripping" the drill string for replacing the bits. Replacement of a drill bit can be required for a number of reasons, including wearing out or breakage of the structure contacting the rock formation.

One of the consistent problems in drill bits is the inconsistency of service life. Sometimes bits are known to last for long periods, whereas bits which are apparently identical operated under similar conditions may fail within a short lifetime. One cause of erratic service life is failure of the bearings. Bearing failure can often be traced to failure of the annular seal that retains lubricant in the bearing. Lubricant may be lost if the seal fails, or abrasive particles of rock may work their way into the bearing surfaces, causing excessive wear.

Rock bit annular seals are being called on to perform service in environments which are extremely harsh. Modern bits are being run at exceptionally high surface speeds, sometimes more than 500 feet per minute, with cone speeds averaging in the range of from 200 to 400 revolutions per minute. One face of the annular seal is exposed to abrasive drilling fluid and mud. The life of the annular seal may be significantly degraded by high temperatures due to friction (as well as elevated temperature in the well bore) and abrasion.

Another factor that is known to limit the life of the annular seal within a rock bit is the differential pressure imposed on the seal in certain rock bit embodiments. Such differential pressure can cause the seal to be extruded outwardly from is placement within the rock bit. While single seal-type rock bits are typically known to include means for equalizing the pressures imposed on opposed sides of the seal to minimize and even eliminate such differential pressure, dual-seal type rock bits often do not include such pressure equalizing means for reasons of packaging constraints. A typical dual-seal rock bit includes a first or primary seal positioned adjacent the journal bearing, and a secondary seal positioned next to the first seal but adjacent the outside environment. While the primary seal serves to prevent the migration of lubricant from the journal bearing, the secondary seal serves to prevent or control the entry of drilling mud and debris into the cone and to the primary seal.

During operation of such dual-seal rock bit it is known that a relatively large pressure differential can exist between the two seals, thereby imposing an outwardly directed force onto one or both of the seals. This pressure force can cause one or both of the seals to be extruded outwardly from its respective placement in the rock bit, thereby causing the seal and ultimately the rock bit to fail.

It is, therefore, desirable that an annular seal for use in a rock bit be constructed in a manner that can minimize and/or prevent extrusion from its placement within the rock caused from differential or other pressure forces. It is desired that the annular seal be configured to provide such anti-extrusion performance without compromising its sealing performance. It is also desired that such an annular seal be configured in a manner that enables its retrofit placement in existing rock bits without the need for modification.

SUMMARY OF THE INVENTION

Annular seals of this invention are specially configured to minimize or eliminate the possibility of seal extrusion from a seal gland within a rock bit. Annular seals of this invention generally comprise an elastomeric seal body that is configured to fit within a seal gland of a rock bit. The seal body is formed from an elastomeric material an is configured having a first seal surface, for providing a seal along a dynamic rotary surface formed between the seal body and one portion of the rock bit, and a second seal surface, for providing a seal between the seal body and another portion of the rock bit.

The annular seal further comprises an extrusion prevention member that is positioned adjacent a surface of the seal body between the first and second seal surfaces. The extrusion prevention member can be integral, partially-attached, or independent of the seal body. The extrusion prevention member is preferably formed from a material having a hardness that is greater than that of the seal body. The member is positioned along the seal body at a location adjacent a groove, formed between opposed members of the rock bit, to act as a physical barrier to prevent the seal from being extruded therethrough.

Annular seals configured comprising the extrusion prevention member enjoy a lengthened service live, when compared to conventional rock bit seals, as they do not suffer the nibbling and tearing caused by being extruded into the groove during rock bit operation, which nibbling and tearing can and does reduce seal sealing area and compromise sealability.

BRIEF DESCRIPTION OF THE DRAWINGS

These and other features and advantages of the present invention will become appreciated as the same becomes better understood with reference to the drawings wherein:

FIG. 1 is a semi-schematic perspective of a rock bit containing an annular seal constructed according to the principles of this invention;

FIG. 2 is a partial cross-sectional view of a rock bit embodiment comprising a single annular seal constructed according to the principles of this invention;

DETAILED DESCRIPTION OF THE INVENTION

Figure 3:
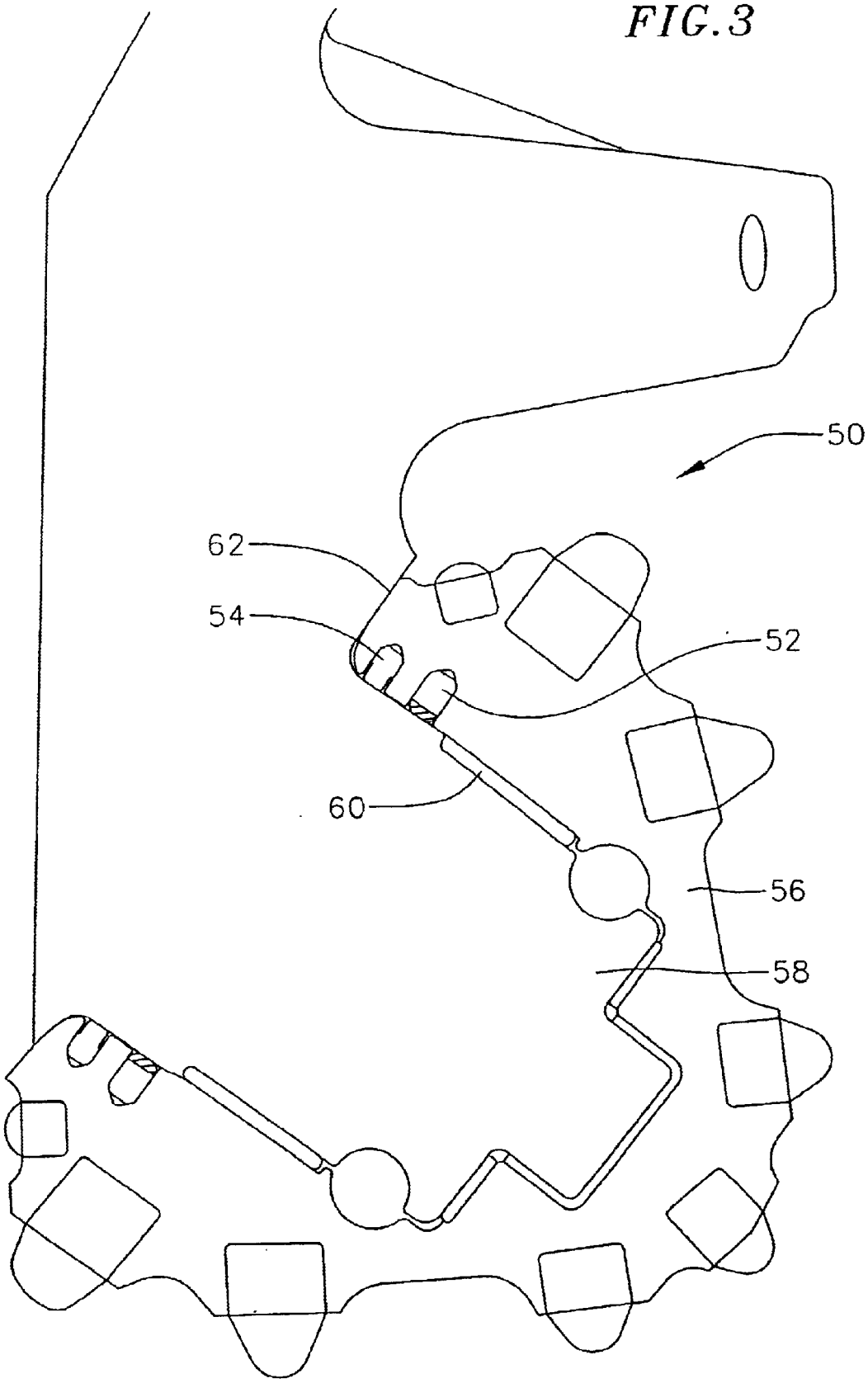
FIG. 3 is a partial cross-sectional view of a rock bit embodiment comprising dual annular seals constructed according to the principles of this invention.

Rock bits employing an annular ring seal constructed according to principles of this invention comprises a body 10 having three cutter cones 11 mounted on its lower end, as shown in FIG. 1. A threaded pin 12 is at the upper end of the body for assembly of the rock bit onto a drill string for drilling oil wells or the like. A plurality of inserts 13 are pressed into holes in the surfaces of the cutter cones for bearing on the rock formation being drilled. Nozzles 15 in the bit body introduce drilling fluid into the space around the cutter cones for cooling and carrying away formation chips drilled by the bit.

Annular journal seals in the form of ring seal are generally thought of as comprising a cylindrical inside and outside diameter, and a circular cross section. Accordingly, for purposes of reference and clarity, some of the figures used to describe the principles and embodiments of this invention have been created to illustrate an annular seal having a generally circular cross section, i.e., in the form of an O-ring seal. However, the principles of this invention are also meant to apply to annular seals having non-circular or asymmetric cross sections. It is, therefore, to be understood that the principles of this invention may apply to annular seal having a circular or non-circular cross sections.

FIG. 2 is a fragmentary, longitudinal cross-section of a rock bit, extending radially from the rotational axis 14 of the rock bit through one of the three legs on which the cutter cones 11 are mounted. Each leg includes a journal pin extending downwardly and radially, inwardly on the rock bit body. The journal pin includes a cylindrical bearing surface having a hard metal insert 17 on a lower portion of the journal pin. The hard metal insert is typically a cobalt or iron-based alloy welded in place in a groove on the journal leg and having a substantially greater hardness that the steel forming the journal pin and rock bit body.

An open groove 18 is provided on the upper portion of the journal pin. Such a groove may, for example, extend around 60 percent or so of the circumference of the journal pin, and the hard metal insert 17 can extend around the remaining 40 percent or so. The journal pin also has a cylindrical nose 19 at its lower end.

Each cutter cone 11 is in the form of a hollow, generally-conical steel body having inserts 13, comprising for example a cemented tungsten carbide material, pressed into holes on the external surface. For long life, the inserts may be tipped with a polycrystalline diamond layer. Such tungsten carbide inserts provide the drilling action by engaging a subterranean rock formation as the rock bit is rotated. Some types of bits have hard-faced steel teeth milled on the outside of the cone instead of carbide inserts.

The cavity in the cone contains a cylindrical bearing surface including an aluminum bronze insert 21 deposited in a groove in the steel of the cone or as a floating insert in a groove in the cone. The aluminum bronze insert 21 in the cone engages the hard metal insert 17 on the leg and provides the main bearing surface for the cone on the bit body. A nose button 22 is between the end of the cavity in the cone and the nose 19 and carries the principal thrust loads of the cone on the journal pin. A bushing 23 surrounds the nose and provides additional bearing surface between the cone and journal pin. Other types of bits, particularly for higher rotational speed applications, have roller bearings instead of the journal bearings illustrated herein. It is to be understood that O-ring seals constructed according to principles of this invention may be used with rock bits comprising either roller bearings or conventional journal bearings.

A plurality of bearing balls 24 are fitted into complementary ball races in the cone and on the journal pin. These balls are inserted through a ball passage 26, which extends through the journal pin between the bearing races and the exterior of the rock bit. A cone is first fitted on the journal pin, and then the bearing balls 24 are inserted through the ball passage. The balls carry any thrust loads tending to remove the cone from the journal pin and thereby retain the cone on the journal pin. The balls are retained in the races by a ball retainer 27 inserted through the ball passage 26 after the balls are in place. A plug 28 is then welded into the end of the ball passage to keep the ball retainer in place.

The bearing surfaces between the journal pin and the cone are lubricated by a grease. Preferably, the interior of the rock bit is evacuated, and grease is introduced through a fill passage (not shown). The grease thus fills the regions adjacent the bearing surfaces plus various passages and a grease reservoir, and air is essentially excluded from the interior of the rock bit. The grease reservoir comprises a cavity 29 in the rock bit body, which is connected to the ball passage 26 by a lubricant passage 31. Grease also fills the portion of the ball passage adjacent the ball retainer, the open groove 18 on the upper side of the journal pin, and a diagonally extending passage 32 therebetween. Grease is retained in the bearing structure by a resilient seal in the form of an annular seal 44 between the cone and journal pin. This first embodiment rock bit comprises a single annular seal and, thus is referred to as a "single-seal" rock bit.

A pressure compensation subassembly is included in the grease reservoir 29. The subassembly comprises a metal cup 34 with an opening 36 at its inner end. A flexible rubber bellows 37 extends into the cup from its outer end. The bellows is held into place by a cap 38 with a vent passage 39. The pressure compensation subassembly is held in the grease reservoir by a snap ring 41.

When the rock bit is filled with grease, the bearings, the groove 18 on the journal pin, passages in the journal pin, the lubrication passage 31, and the grease reservoir on the outside of the bellows 37 are filled with grease. If the volume of grease expands due to heating, for example, the bellows 37 is compressed to provide additional volume in the sealed grease system, thereby preventing accumulation of excessive pressures. High pressure in the grease system can damage the annular seal 44 and permit drilling fluid or the like to enter the bearings. Such material is abrasive and can quickly damage the bearings. Conversely, if the grease volume should contract, the bellows can expand to prevent low pressures in the sealed grease system, which could cause flow of abrasive and/or corrosive substances past the annular seal.

The bellows has a boss 42 at its inner end which can seat against the cap 38 at one end of the displacement of the bellows for sealing the vent passage 39. The end of the bellows can also seat against the cup 34 at the other end of its stroke, thereby sealing the opening 36. If desired, a pressure relief check valve can also be provided in the grease reservoir for relieving over-pressures in the grease system that could damage the annular seal. Even with a pressure compensator, it is believed that occasional differential pressures may exist across the annular seal of up to 150 psi (550 kilopascals). Thus, although such first rock bit embodiment is constructed in a manner to address and minimize the potential for a built-up pressure within the bit, and a resultant pressure differential across the annular seal, such pressure differentials can still occur. Therefore, seal constructions of this invention can be used in such single seal rock bit embodiments to prevent the extrusion effects that could result from any such occasional pressure differential.

FIG. 3 illustrates a example rock bit 50 constructed having two annular seals 52 and 54, and that are thereby referred to as "dual-seal" rock bits. The annular seals in a dual seal rock bit can be positioned differently within the rock bit depending on the size, packaging, and application of the rock bit. For purposes of illustration and reference, the dual seal rock bit presented in FIG. 3 illustrates but one example of how the seals can be positioned within the rock bit. In this particular example, the seals 52 and 54 are positioned side-by-side of one another in respective seal cavities that are formed between the rock bit cone 56 and leg 58.

In this dual seal rock bit the annular seal 52 is referred to as a first or primary annular seal that is positioned adjacent the rock bit bearing 60 for purposes of maintaining lubricant or grease between the bearing surfaces. The annular seal 54 is referred to as a secondary annular seal and is positioned adjacent the end 62 of the cone 56 to minimize or prevent the ingress of drilling debris between the cone and leg surfaces and axially outwardly toward the primary seal 52.

Like single-seal rock bits, dual-seal rock bits come in many different sizes, depending on the particular application. Some of the larger dual-seal rock bits are known to comprise a pressure compensation subassembly disposed therein, as described above, for purposes of addressing unwanted pressure build up within the bit and between the seals during operation. However, because of packaging and spatial constraints, some of the smaller dual-seal rock bits, e.g., those under 8½ inches in size, do not contain the pressure compensation subassembly. Therefore, the annular seals in such smaller sized dual seal rock bits are especially susceptible to uncontrolled pressure effects within the rock bit that can cause one or both of the seals to be damaged by extrusion.

Internal pressures within rock bits are caused by the elevated temperatures that occur within a bit during operation. In some deep hole drilling applications, internal rock bit temperatures can go as high as 300 EF. During any drilling operation there are external pressures acting on the rock bit that can be as high as 10,000 psi. This pressure is equalized within a rock bit by the pressure compensation subassembly, so that the annular seal has equivalent pressure acting on both the mud side (i.e., the side of the annular seal positioned adjacent the rock bit external environment) and the bearing side (i.e., the side of the annular seal positioned adjacent the rock bit seal) of the seal. This pressure equalization is important for purposes of maintaining proper seal positioning within the seal cavity in the rock bit.

As mentioned above, some rock bits do not have a pressure compensation subassembly. In such rock bits, and in rock bits having pressure compensation subassemblies that do not operate properly or have failed, the pressure differential applied across the annular seal during rock bit operation is unchecked. This unchecked differential pressure can exert an undesired pressure force on the seal in an axial direction within the seal cavity. The direction that the seal is urged depends on whether the rock bit external or internal pressure is controlling, which will depend on the particular rock bit design, drilling application and operating conditions. In situations where the rock bit external pressure is controlling, the annular seal will be forced within the seal cavity in a direction towards the bearing. In situations where the rock bit internal pressure is controlling, the annular seal will be forced within the seal cavity in a direction towards the rock bit external environment.

In either case, the pressure force exerted on the seal causes a sidewall portion of the seal to be nibbled, sliced, and/or extruded between a groove that extends outwardly from the seal cavity and that is formed between opposed cone and journal surfaces. Typically, the damage to the annular seal is known to occur along the seal sidewall surface perpendicular a seal sealing surface. Because the damage that can occur to the seal is proximate to the seal sealing surface, such damage can compromise the seal's ability to provide and maintain a desired seal, and can ultimately result in seal and rock bit failure. This is especially true the extruded portion of the seal has been sliced away from the seal body. A common seal failure mechanism occurs when the pressure force operates to cause a portion of the seal sidewall surface to be extruded, and the extruded portion of the seal is sliced or otherwise torn away from the seal body, taking with it a portion of the adjacent seal sealing surface. This damage immediately reduces the contact area of the seal sealing surface, which can and is known to cause seal leakage and ultimately seal failure.

In dual seal rock bits, such as that illustrated in FIG. 3, the pressure build up is known to occur between the two seals, thereby exerting an oppositely directed pressure force on both of the seals. Such pressure force operates to urge the seals away from one another in their respective seal cavities. Referring to FIG. 3, this internal pressure force can act to urge the primary annular seal 52 within its seal cavity towards the bearing, and can act to urge the secondary annular seal 54 within its seal cavity towards the end 60 of the cone. In each case, if the internal pressure is great enough, a sidewall portion of each seal adjacent the leg sealing surface can be urged and extruded into a groove extending from each respective seal cavity that is formed between the cone and leg.

While the cause of such extrusion damage to rock bit annular seals has been described as being pressure induced, i.e., caused by an unchecked internal or external differential pressure across the seal, other occurrences in the rock bit can cause this damage. For example, it is known that rock bit cone movement within assembly clearances can cause the seal to be sufficiently displaced within the seal cavity during drilling operations to cause annular seal nibbling, slicing, and extrusion damage. It is also known that shale packing, whereby shale from the drilling operation is pushed or packed between the cone and the rock bit leg, can enter the seal cavity and cause the annular seal to be forced within the cavity and extruded between a groove formed between the cone and leg towards the rock bit bearing.

In an effort to minimize and/or eliminate the above-described extrusion damage to rock bit annular seals, annular seals of this invention have been constructed to include one or more member that is designed to provide reinforcement to that portion of the seal body surface that may otherwise be vulnerable to extrusion. Additionally, to maintain the desired properties of the annular seal at the pressure and temperature conditions that prevail in a rock bit, to inhibit "pumping" of the grease through the annular seal, and for a long useful life, it is important that the annular seal be resistant to crude gasoline and other chemical compositions found within oil wells, have a high heat and abrasion resistance, have low rubbing friction, and not be readily deformed under the pressure and temperature conditions in a well which could allow leakage of the grease from within the bit or drilling mud into the bit.

Seal constructions of this invention comprise a seal body that is formed from an elastomeric material selected from the group of carboxylated elastomers such as carboxylated nitrites, highly saturated nitrile (HSN) elastomers, nitrile-butadiene rubber (HBR), highly saturated nitrile-butadiene rubber (HNBR) and the like. Particularly preferred elastomeric materials are HNBR and HSN. An exemplary HNBR material is set forth in the examples below. Other desirable elastomeric materials include those HSN materials disclosed in U.S. Pat. No. 5,323,863, that is incorporated herein by reference, and a proprietary HSN manufactured by Smith International, Inc., under the product name HSN-8A. It is to be understood that the HNBR material set forth in the example, and the HSN materials described above, are but one example of elastomeric materials useful for making annular according to this invention, and that other elastomeric materials made from different chemical compounds and/or different amounts of such chemical compounds may also be used.

It is desired that such elastomeric materials have a modulus of elasticity at 100 percent elongation of from about 400 to 2,000 psi (3 to 12 megapascals), a minimum tensile strength of from about 1,000 to 7,000 psi (6 to 42 megapascals), elongation of from 100 to 500 percent, die C tear strength of at least 100 lb/in. (1.8 kilogram/millimeter), durometer hardness Shore A in the range of from about 60 to 95, and a compression set after 70 hours at 100 EC of less than about 18 percent, and preferably less than about 16 percent.

An exemplary elastomeric composition may comprise per 100 parts by weight of elastomer (e.g., HSN, HNBR and the like), furnace black in the range of from 20 to 50 parts by weight, peroxide curing agent in the range of from 7 to 10 parts by weight, zinc oxide or magnesium oxide in the range of from 4 to 7 parts by weight, stearic acid in the range of from 0.5 to 2 parts by weight, and plasticizer up to about 10 parts by weight.

Figure 5A:
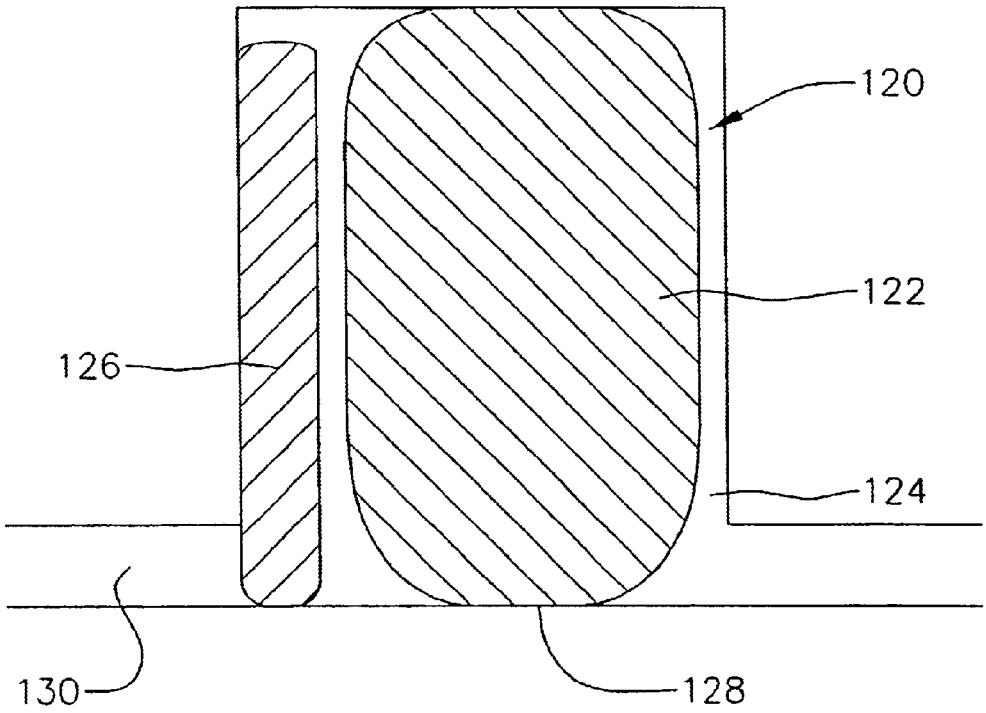
FIGS. 5A and 5B are cross-sectional side views of second annular seal embodiments constructed according to principles of this invention.
Figure 5B:
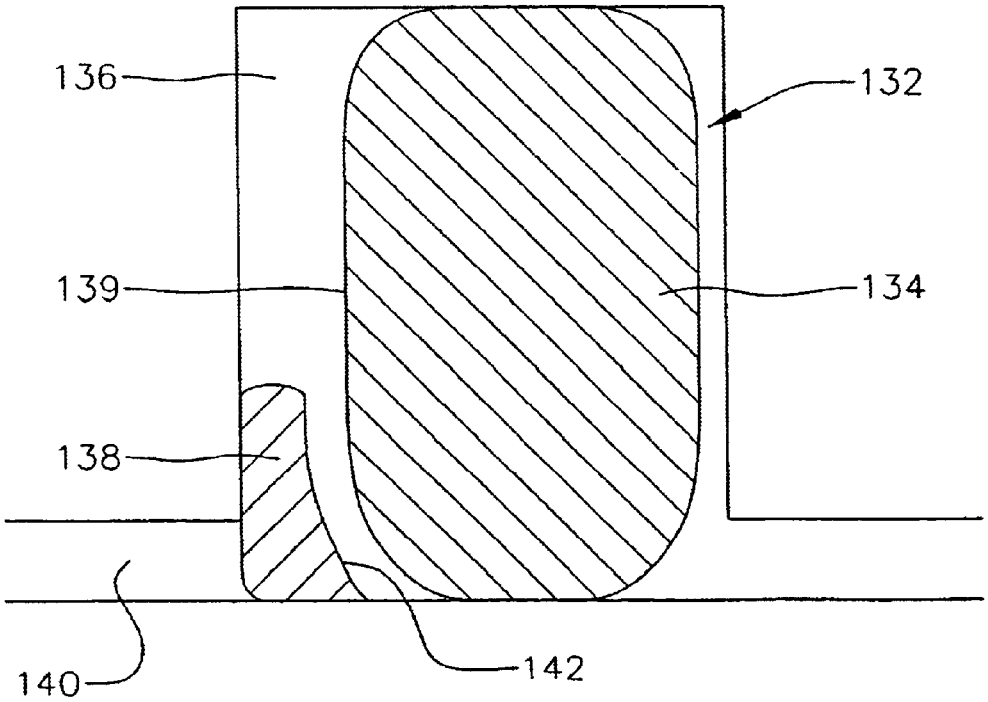
Figure 6:
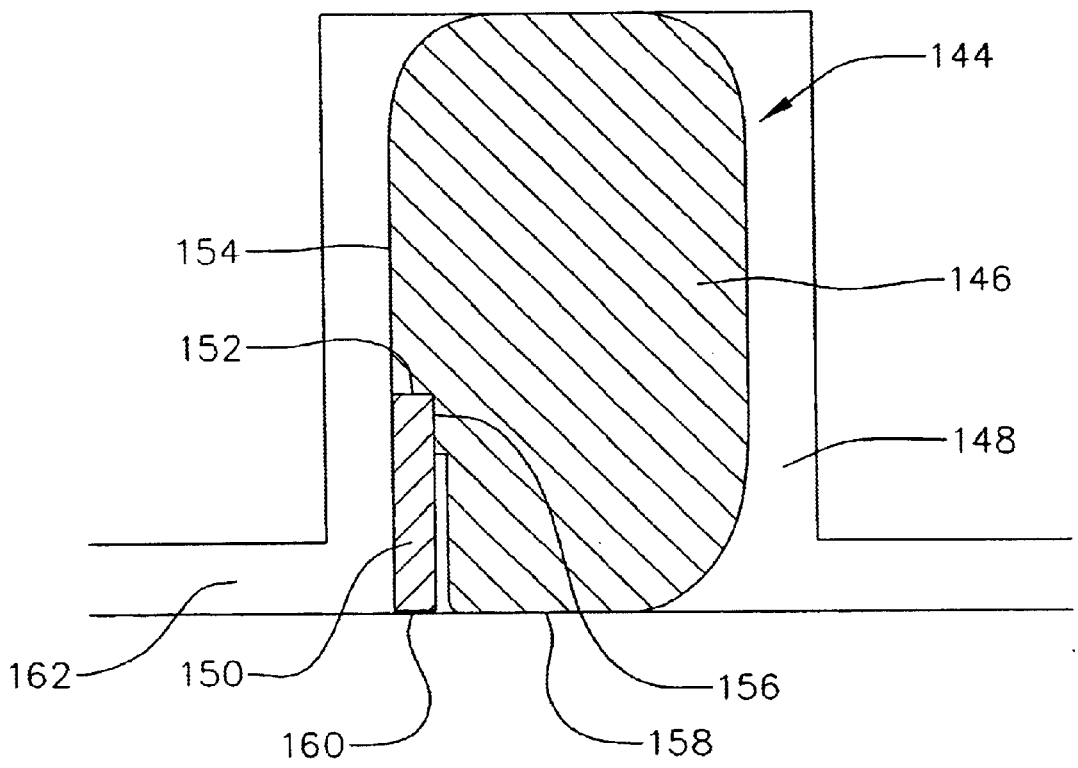
FIG. 6 is a cross-sectional side view of a third annular seal embodiment constructed according to principles of this invention.

Generally speaking, annular seals of this invention are constructed having at least three different embodiments to prevent seal extrusion; namely a first seal embodiment comprising a seal body having one or more integral reinforcement members (FIGS. 4A to 4C), a second seal embodiment comprising a seal body and one or more non-integral extrusion prevention members or rings (FIGS. 5A and 5B), and a third seal embodiment comprising a seal body and one or more partially-attached extrusion prevention members (FIG. 6).

In each of these seal embodiments the seal body is formed from an elastomeric material as discussed above. The seal body includes first and second sealing surfaces, wherein one sealing surface is dynamic in that it is in rotary contact with an opposed sealing surface of the rock bit, and wherein the other sealing surface is relatively static in that is in contact with an opposed surface of the rock bit that is relatively static when compared to the dynamic sealing surface. In the example embodiments presented, the seal body sealing surfaces are positioned along the inside and outside diameter positions of the seal body. The seal body can be configured having either a symmetric or an asymmetric cross section. Additionally, depending on the particular seal application, the annular seal may comprise a seal body having static and/or dynamic surfaces formed from materials different than that used to form the seal body.

For example, annular seals of this invention may comprise, in addition to an extrusion prevention member, one or both sealing surfaces (e.g., a dynamic sealing surface) formed from an elastomeric material that is relatively harder than that used to form the seal body, as recited in U.S. Pat. No. 5,842,701, which is incorporated herein by reference. Annular seals of this invention may also comprise, in addition to an extrusion prevention member, one or both sealing surfaces (e.g., a dynamic sealing surface) formed from a composite material in the form of an elastomer/fiber fabric, as recited in U.S. Pat. No. 5,842,700, which is also incorporated herein by reference. Thus, it is to be understood within the scope of this invention that annular seals of this invention may comprise a composite of more than one type of material.

Figure 4A:
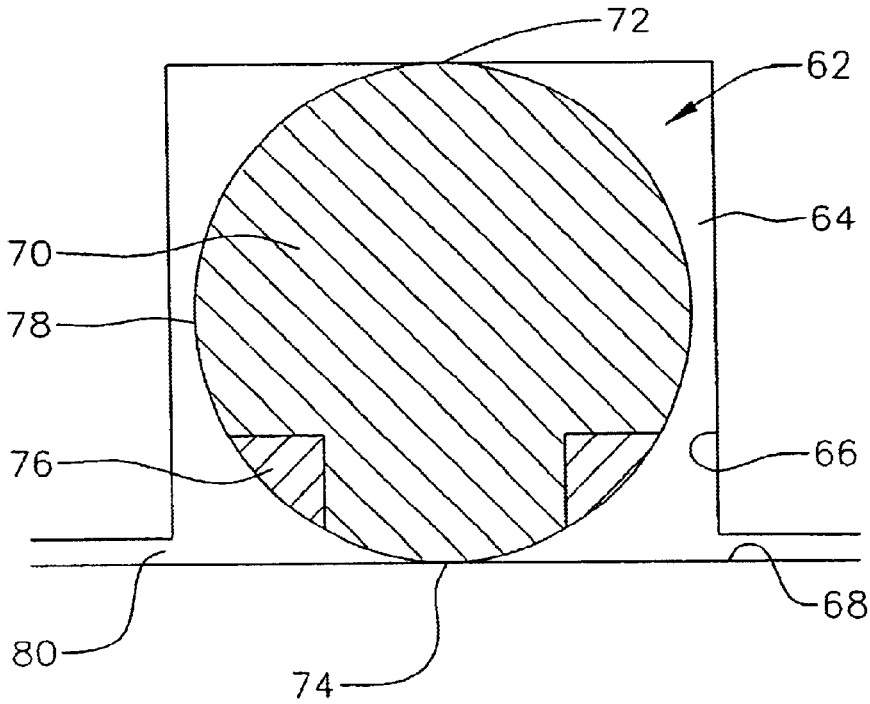
FIGS. 4A to 4C are cross-sectional side views of first annular seal embodiments constructed according to principles of this invention.
Figure 4B:
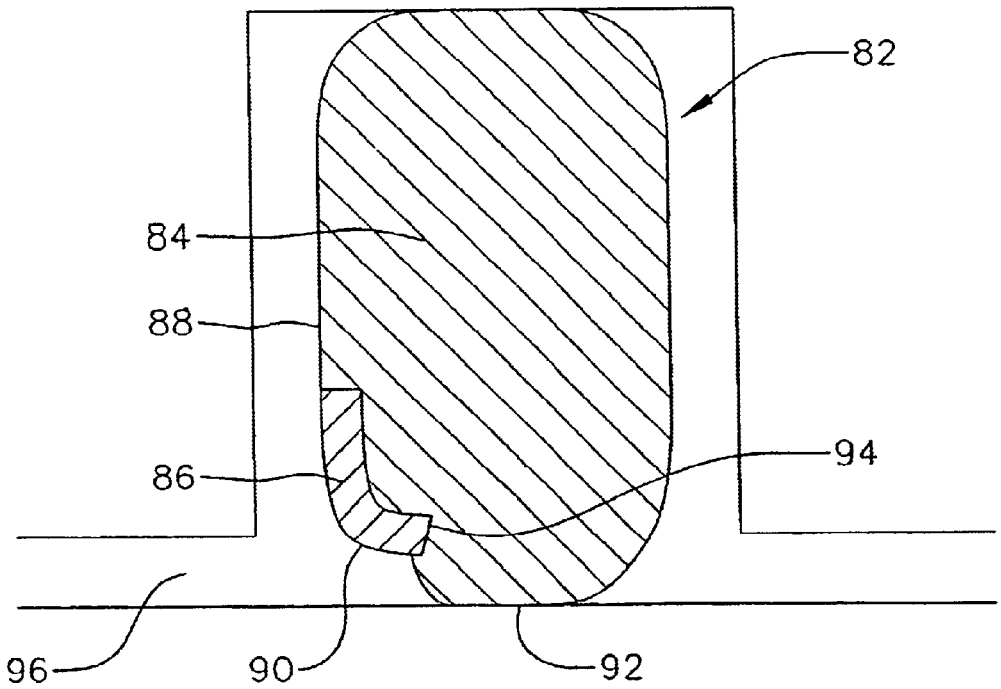
Figure 4C:
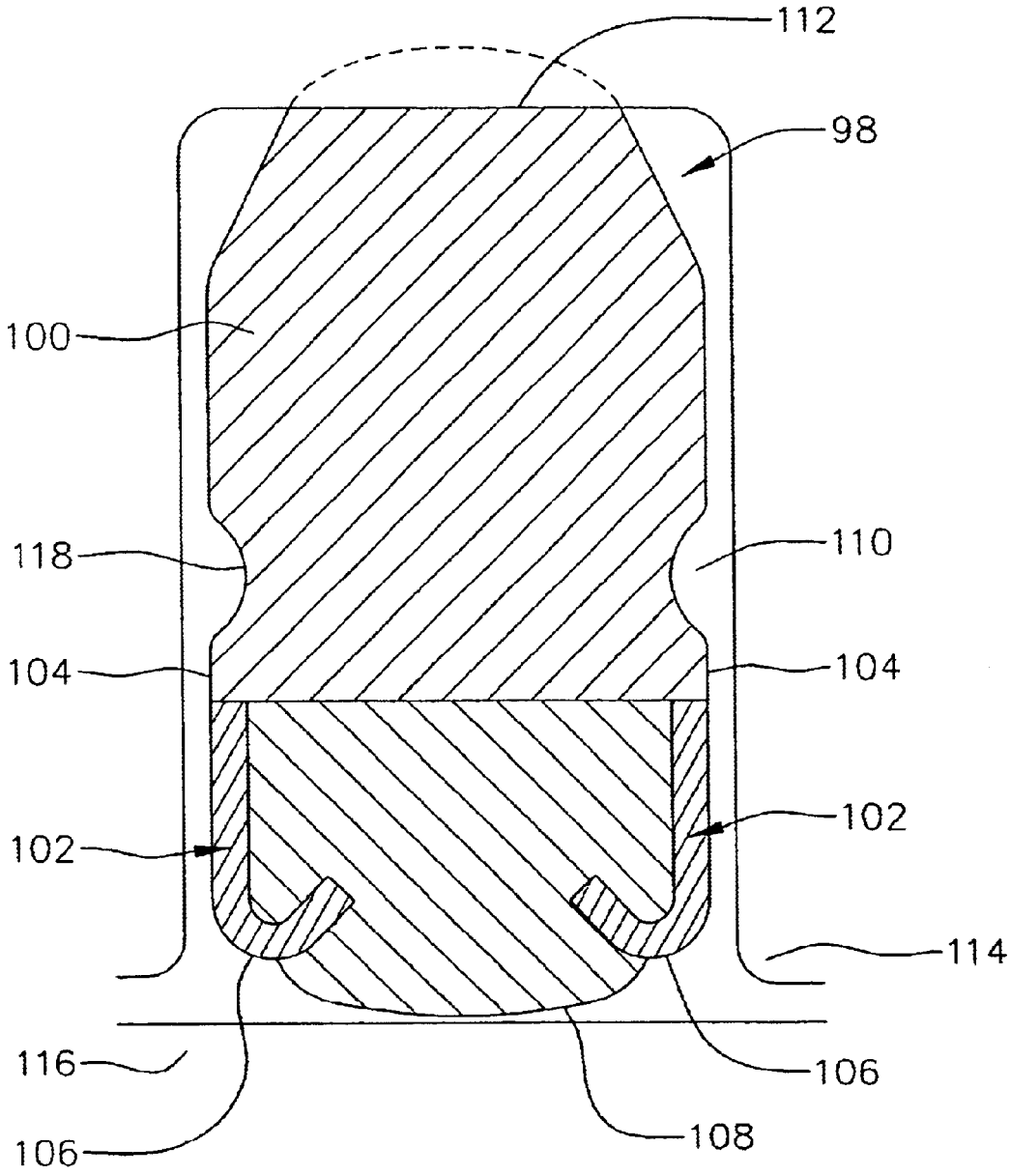

FIGS. 4A to 4C illustrate first embodiment annular seals of this invention comprising an extrusion prevention member that is integral with the annular seal body, i.e., a one-piece construction, and that is positioned along a surface portion of the seal body that makes up neither the dynamic nor the static sealing surfaces. It is important to note that the extrusion prevention member, used with annular seals of this invention, are positioned at locations along the seal body that are not conventional wear surfaces of the seal. This is the case because, for an annular seal disposed within a seal gland formed between opposed surfaces, the location for potential extrusion of the seal is the small groove or opening between such surfaces, and removed from the static or dynamic sealing surfaces. Thus, for proper anti-extrusion performance, the extrusion prevention member is positioned remote from the seal sealing surfaces and adjacent the small groove or opening.

FIG. 4A illustrates an annular seal 62 disposed within a seal cavity 64 that is formed between a rock bit cone 66 and leg 68 surfaces. The annular seal 62 comprises a seal body 70 having a first sealing surface 72 at one seal diameter (e.g., along an outside seal diameter), and a second sealing surface 74 at an opposite diameter (e.g., along an inside seal diameter), wherein the first and second sealing surfaces are positioned against respective cone and leg sealing surfaces. In this rock bit embodiment, the second sealing surface 74 is dynamic in that it is in rotary contact with the leg 68, and the first sealing surface 72 is substantially static, relative to the second seal surface, as it is positioned against a relatively fixed cone surface.

The annular seal 62 includes a extrusion prevention member 76 that is positioned at least a partial length along a sidewall portion 78 of the seal body as defined between the seal sealing surfaces 72 and 74. The extrusion prevention member does not form a part of either the first or second sealing surfaces. The extrusion prevention member 76 is positioned along the seal body so that it is adjacent a groove 80 extending outwardly from the seal cavity 64, formed between the adjacent cone and leg surfaces, when loaded within the seal cavity 64 to protect the seal against being extruded through the groove.

Annular seals of this invention may include one or more such integral extrusion prevention member positioned along the seal body sidewall portion, depending on the particular rock bit configuration, drilling application, and/or operating conditions. For example, annular seals comprising two extrusion prevention members, each positioned along opposed seal body sidewall portions as illustrated in FIG. 4A, may be used in rock bits that are known to expose the annular seal to extrusion forces in either direction within the seal cavity. Annular seals comprising only a single extrusion prevention member, positioned along a single seal body sidewall portion, may be used in rock bits that are known to expose the annular seal to an extrusion force in a single direction within the seal cavity.

Annular seals as presented in FIGS. 4A to 4C have, for purposes of illustration and reference, been depicted within a simplistic seal cavity comprising only a single seal. Annular seals of this invention are intended to be used with many different configurations of seal cavities, and many different configurations of rock bits that may contain one or more annular seals. Accordingly, it is to be understood within the scope of this invention that annular seals of this invention can be used with a variety of differently configured seal cavities other than that specifically described and/or illustrated.

The seal body 70 can be formed from one of the elastomeric materials discussed above according to conventional methods that are well known in the art. Although not illustrated in FIG. 4A, and as discussed briefly above, one or more of the seal body sealing surfaces may be formed from a material different than that of the sealing body. The extrusion prevention member 76 is formed from a material having a durometer or hardness that is sufficiently higher than that of the seal body to provide stiffness and reinforcement to the portion of the seal (the sidewall portion 78 in FIG. 4A) adjacent the groove 80. In this capacity, the higher hardness material serves to reduce the susceptibility of the more vulnerable and relatively softer corners of the seal body to nibbling, slicing, extrusion, and any other adverse influences of the groove 80 during operation.

The materials used to form the extrusion prevention member can be selected from the group of materials consisting of rubbers, polymer plastics, fabrics, and composites thereof. Suitable rubber materials capable of forming the extrusion prevention member includes those discussed above for the seal body have a greater hardness than that of the rubber selected for the seal body. A further desired feature of the rubber material used to form the extrusion prevention member is that it be chemically compatible with the elastomeric material used to form the seal body for purposes of forming an integral, one-piece member with the seal body.

Fabric or fiber materials useful for forming the extrusion prevention member include those comprising a composite of nonelastomeric polymeric fiber disposed within an elastomeric medium. An example of such composite is a fabric that is formed by impregnating a nonpolymeric fiber material with an elastomeric material, and layering the impregnated fiber material to form a fabric, as disclosed in U.S. Pat. No. 5,842,700. Such a composite fabric material is both chemically compatible with the seal body elastomer, to facilitate bonding therewith to form an integral member, and has a durometer or hardness that is sufficiently higher than the seal body material to provide stiffness and rigidity to the desired seal body surface portion in need of reinforcement.

FIG. 4B illustrates an annular seal 82 comprising a seal body 84 having an extrusion prevention member 86 positioned along only one seal body sidewall portion 88. Again, although the extrusion prevention member is described as being placed along a sidewall portion of the seal body, this placement is not intended to be limiting as the extrusion prevention member can be positioned anywhere along the seal body that is exposed to potential extrusion. A limitation to this placement is that the extrusion prevention member is not positioned along a conventional seal wear surface, e.g., along the sealing surfaces.

The extrusion prevention member 86 illustrated in FIG. 4B is configured differently than that illustrated in FIG. 4A, in that it includes a lobe 90 or curved surface that is directed towards a seal sealing surface 92. In this particular embodiment, the extrusion prevention member 86 is configured having a curved lobe 90 that is recessed a distance away from the seal sealing surface 92. In a preferred embodiment, the extrusion prevention member 86 is formed from the elastomeric fabric material discussed above, and includes an end 94 that is tucked into the seal body where it meets the seal sidewall portion. The extrusion prevention member is tucked into the seal body in this manner, i.e., is positioned within the seal body directionally opposite a potential pressure force on the seal, to both increase the fabric reinforcement bond strength at a vulnerable location of the seal body, and to provide an added measure of extrusion resistance to the seal body at a position adjacent the groove.

FIG. 4C illustrates an annular seal 98 comprising a seal body 100 having extrusion prevention members 102 positioned along opposed seal body surfaces, and specifically along seal body sidewall portions 104. The extrusion prevention members 102 are configured similar to that disclosed above and illustrated in FIG. 4B, each comprising a lobe 106 or curved surface that is directed towards a seal sealing surface 108. The curved lobe of each extrusion prevention member 102 is recessed a distance away from the seal sealing surface 108. The extrusion prevention member is formed from the fabric material discussed above and is tucked into the seal body where it meets the sidewall surface extending to the sealing surface as described above. As mentioned above, this particular embodiment is useful in rock bit applications where the annular seal may be subjected to differential pressure or mechanical forces acting on either side of the annular seal.

The annular seal of FIG. 4C includes a sealing surface 108 that is formed from a material different than that used to form the seal body 100. Additionally, the seal body 100 is configured having an asymmetrical cross-sectional shape prior to being loaded within the seal cavity, wherein a seal sealing surface 112 positioned against the cone 114 has a radius of curvature that is less than that of the seal sealing surface 108 positioned against the leg, as disclosed in U.S. Pat. No. 5,842,701.

The annular seal 98 further includes a recessed groove 118 on each of the seal body side portions that is positioned away from the extrusion prevention member 102 and between the sealing surfaces 108 and 112. The recessed grooves are optional and serve to reduce or relieve the pressure in the higher durometer extrusion prevention member material as the seal wears during its intended life.

FIG. 5A illustrates a second embodiment of an annular seal 120, constructed according to principles of this invention, comprising a seal body 122 that is disposed within a rock bit seal cavity 124. Unlike the previously described seal embodiments, the second seal embodiment comprises an extrusion prevention member 126 that is separate and independent of the seal body, and that is in the form of an annular ring. For this reason the seal body and extrusion prevention member can be thought of as a two-piece seal. The extrusion prevention member 126 is formed from the same types of materials described above that have a durometer or hardness that is greater than that of the seal body to protect the seal body against undesired extrusion.

The extrusion prevention member 126 is positioned within the seal cavity 124 adjacent a surface portion of the seal susceptible to extrusion, e.g., a seal sidewall portion. The member 126 extends along a portion of seal surface extending from a seal sealing surface 128 such that the extrusion prevention member is interposed between the seal and the groove 130 from the seal cavity. Configured and positioned in this manner, the extrusion prevention member serves to stabilize the seal in the seal cavity and prevent the seal from being extruded into the groove when subjected to a pressure or other mechanical force within the seal cavity. Again, like the seal embodiments described and illustrated above, the extrusion prevention member is positioned along a surface of the seal remote from the sealing surfaces.

Although the extrusion prevention member 126 is illustrated in FIG. 5A as occupying a large portion of the seal cavity, it is to be understood that extrusion prevention members of this invention embodiment can be sized differently, e.g., to occupy a desired portion of the seal cavity adjacent the groove. Additionally, the extrusion prevention member 126 of FIG. 5A has been illustrated as having a generally rectangular cross section. It is to be understood that the extrusion prevention member can be configured having a any number of different cross-sectional geometries as called for by the particular seal and/or seal cavity configuration.

For example, FIG. 5B illustrates a second embodiment annular seal 132 comprising a seal body 134 disposed within a seal cavity 136, and an extrusion prevention member 138 that is both positioned next to a sidewall portion 139 of the seal, and that is a separate and independent member of the seal. Unlike the second embodiment annular seal illustrated in FIG. 5A, however, the extrusion prevention member 138 in FIG. 5B is configured to occupy only a partial space within the seal cavity adjacent the groove 140. Additionally, the extrusion prevention member is configured having a nonrectanular shape. Specifically, the extrusion prevention member is configured having a surface 142 adjacent the seal that is curved to match or closely match the curvature of the opposed seal body surface.

FIG. 6A illustrates a third embodiment of an annular seal 144, constructed according to principles of this invention, comprising a seal body 146 that is disposed within a rock bit seal cavity 148. Unlike the previously described seal embodiments, the third seal embodiment comprises an extrusion prevention member 150 that is partially attached to the seal body. Accordingly, the extrusion prevention member 150 in this third annular seal embodiment includes a portion that is permanently attached to the seal body, and a portion that extends outwardly from the seal body.

In the example embodiment illustrated in FIG. 6, the extrusion prevention member 150 includes a first end 152 that is attached to the seal body adjacent to a sidewall portion 154 of the seal. The extrusion prevention member includes a side surface that is also attached to the seal body. In an example embodiment, the extrusion prevention member 150 has a rectangular shape and extends freely from the connected first end 152 a distance along the seal sidewall portion towards a sealing surface 158 and to a extrusion prevention member second end 160. Configured in this manner, the extrusion prevention member is partially attached to the seal body and is interposed between the seal and the groove 162 to prevent the seal from being extruded therethrough.

The extrusion prevention member can be formed from the same materials discussed above for the first annular seal embodiment. Since the extrusion prevention member of this third embodiment is partially attached to the seal body, it is desired that the extrusion prevention member material be compatible with the elastomeric material used to form the seal body.

A key feature of annular seals of this invention is the use of the integral, partially-attached, or independent extrusion prevention members for purposes of reinforcing, stabilizing, and protecting an otherwise vulnerable portion of the seal from being extruded from the seal cavity. Although the annular seal embodiments of this invention have been described and illustrated in the context of a single seal disposed within a single seal cavity, annular seals of this invention are intended to be used with dual-seal rock bits as well as with single-seal rock bits. In such dual-seal rock bit service the annular seals of this invention can be used as the primary and/or secondary seals. Accordingly, it is to be understood within the scope of this invention that the number and placement of seals, constructed according to principles of this invention, in rock bits are not intended to be limited and can vary depending on the rock bit configuration.

Additionally, while the seal embodiments of this invention have been illustrated in most instances as comprising a seal body formed from a single material, it is to be understood that seals of this invention can have sealing surfaces formed from materials different than the seal body, and that such is intended to be within the scope of this invention. Further, although many of the seal embodiments illustrated comprise a seal having a seal body configured with a high-aspect ratio or asymmetrical cross section, it is to be understood that seals of this invention can be configured in the form of an O-ring having a circular or symmetric cross section.

Annular seals of this invention, comprising the extrusion prevention member, serve to reinforce and/or stabilize the seal within the seal cavity during rock bit operation to prevent a portion of the seal from being extruded through a groove, formed between opposed cone and leg surfaces, due to differential pressure or mechanical forces acting on the seal. Thus, annular seals of this invention help to prevent seal failure, thereby acting to extend seal and rock bit service life.

What is claimed is:

1. A rotary cone rock bit comprising:

a bit body;

at least one journal extending inwardly and downwardly from a lower portion of the bit body;

a cutter cone mounted for rotation on the journal; and an annular seal positioned between the cone and journal, the annular seal comprising an elastomeric seal body having:

a first seal surface for providing a seal along a dynamic rotary surface formed between the seal body and one of the of the cone or the journal;

a second seal surface for providing a seal between the seal body and the other of the cone or the journal; and an extrusion prevention member positioned adjacent a surface of the seal body between the first and second seal surfaces, the extrusion prevention member having a hardness that is greater than that of the seal body.

2. The rock bit as recited in claim 1 wherein the annular seal is disposed within a seal cavity formed between the cone and journal, and wherein the extrusion prevent member is interposed between the seal and a groove defined between opposed cone and journal surfaces.

3. The rock bit as recited in claim 1 wherein the extrusion prevention member is integral with the seal body and is positioned along a sidewall portion of the seal body.

4. The rock bit as recited in claim 1 wherein the extrusion prevention member is in the form of an annular ring that is independent from the seal body.

5. The rock bit as recited in claim 1 wherein the extrusion prevention member is partially-attached to the seal body.

6. The rock bit as recited in claim 1 comprising two extrusion prevention members each positioned along opposed seal body surface portions located between the first and second seal surfaces.

7. The rock bit as recited in claim 6 wherein the first seal surface has a radius of curvature that is greater than a radius of curvature for the second seal surface.

8. The rock bit as recited in claim 1 wherein the extrusion prevention member is formed from a composite material comprising a fabric formed from a nonelastomeric polymeric material bonded with an elastomeric material.

9. The rock bit as recited in claim 1 wherein the rock it is a dual-seal rock bit.

10. The rock bit as recited in claim 1 wherein the extrusion prevention member is independent of the first and second sealing surfaces.

11. A rotary cone rock bit comprising:

a bit body;

at least one journal extending inwardly and downwardly from a lower portion of the bit body;

a cutter cone mounted for rotation on the journal; and an annular ring seal positioned within a seal cavity between the cone and journal, the annular seal comprising an elastomeric seal body having:

a first seal surface for sealing against a sealing surface on one of the cone or the journal;

a second seal surface for sealing against a sealing surface of the other of the cone or the journal; and an extrusion prevention member disposed within the seal cavity along at least a portion of the seal body between the first and second seal surfaces, the extrusion prevention member being interposed between the seal and a groove extending outwardly from the seal cavity, and being formed from a material that is relatively harder than the material used to form the elastomeric seal body.

12. The rock bit as recited in claim 11 wherein the extrusion prevention member is integral with the seal body and forms a sidewall portion the seal body independent of the first and second sealing surfaces.

13. The rock bit as recited in claim 12 wherein the extrusion prevention member comprises a fabric material.

14. The rock bit as recited in claim 13 wherein the fabric comprises elastomeric and nonelastomeric polymeric components.

15. The rock bit as recited in claim 14 wherein the nonelastomeric polymeric component is in the form of fibers that are woven into the form of the fabric, and wherein the fabric is impregnated with the elastomeric component.

16. The rock bit as recited in claim 11 comprising two extrusion prevention members each disposed along opposed seal body surfaces positioned between the first and second seal surfaces.

17. The rock bit as recited in claim 11 wherein the extrusion prevention member is at least partially-attached to the seal body.

18. The rock bit as recited in claim 11 wherein the extrusion prevention member is independent from the seal body and is in the form of an annular ring.

19. The rock bit as recited in claim 11 wherein one or both of the first and second seal surface is formed from a material that is harder than that used to form the seal body.

20. The rock bit as recited in claim 11 wherein the first seal surface has a radius of curvature prior to placement within the rock bit that is greater than a radius of curvature for the second seal surface.

21. A rotary cone rock bit comprising:

a bit body;

at least one journal extending inwardly and downwardly from a lower portion of the bit body;

a cutter cone mounted for rotation on the journal; and an annular ring seal positioned within a seal cavity between the cone and journal, the annular seal comprising an elastomeric seal body having:

a first seal surface for providing a rotary seal with a sealing surface of the journal;

a second seal surface for providing a seal against a sealing surface on the cone; and an extrusion prevention member at least partially attached to the seal body and that is disposed within the seal cavity along a surface of the seal body extending between the dynamic and relatively static seal surfaces, the extrusion prevention member being interposed between the seal and a groove extending outwardly from the seal cavity, and being formed from a material that is harder than that used to form the elastomeric seal body to stiffen and reinforce the seal body.

22. The rock bit as recited in claim 21 wherein the extrusion prevention member is formed from a composite material comprising elastomeric and nonelastomeric polymeric components.

23. The rock bit as recited in claim 22 wherein the nonelastomeric polymeric component is in the form of fibers that are woven into the form of a fabric, and wherein the fabric is impregnated with the elastomeric component.

24. The rock bit as recited in claim 21 comprising two extrusion prevention members each disposed along opposed seal sidewall portions between the first and second seal surfaces.

25. The rock bit as recited in claim 21 wherein at least one of the first and second seal surfaces is formed from a material that is harder than that used to form the seal body.

26. The rock bit as recited in claim 21 wherein the first seal surface has a radius of curvature prior to placement within the rock bit that is greater than a radius of curvature for the second seal surface.

27. A rotary cone rock bit comprising:

a bit body;

at least one journal extending inwardly and downwardly from a lower portion of the bit body;

a cutter cone mounted for rotation on the journal; and an annular ring seal positioned within a seal cavity between the cone and journal, the annular seal comprising an elastomeric seal body having:

a first seal surface for providing a rotary dynamic seal with a sealing surface on the journal;

a second seal surface for providing a seal with a sealing surface on the cone, wherein the first seal surface has a radius of curvature prior to placement within the seal cavity that is less than a radius of curvature for the second seal surface; and an extrusion prevention member that is integral with a surface portion of the seal extending between and independent from the first and second seal surfaces, the extrusion prevention member being interposed between the seal body and a groove extending outwardly from the seal cavity, and being formed from a material that is harder than that used to form the elastomeric seal body to stiffen and reinforce the seal body.

* * * * *